US010206468B2

(12) United States Patent
Luo

(10) Patent No.: US 10,206,468 B2
(45) Date of Patent: Feb. 19, 2019

(54) STRETCHABLE BOTTLE CONTAINER

(71) Applicant: Xiaobo Luo, Shenzhen (CN)

(72) Inventor: Xiaobo Luo, Shenzhen (CN)

( * ) Notice: Subject to any disclaimer, the term of this patent is extended or adjusted under 35 U.S.C. 154(b) by 0 days.

(21) Appl. No.: 15/530,455

(22) PCT Filed: Jun. 15, 2015

(86) PCT No.: PCT/CN2015/000403
§ 371 (c)(1),
(2) Date: Jan. 18, 2017

(87) PCT Pub. No.: WO2016/019697
PCT Pub. Date: Feb. 11, 2016

(65) Prior Publication Data

US 2017/0258188 A1 Sep. 14, 2017

(30) Foreign Application Priority Data

Aug. 8, 2014 (CN) ..... 2014 2 0448924 U

(51) Int. Cl.
*A45B 25/24* (2006.01)
*A45B 25/28* (2006.01)
(Continued)

(52) U.S. Cl.
CPC ..... *A45B 25/24* (2013.01); *A45B 25/28* (2013.01); *A45C 7/0036* (2013.01);
(Continued)

(58) Field of Classification Search
CPC ..... A45B 25/24; A45B 25/28; A45B 11/02; A45B 11/00; A45C 7/0036; A45C 13/008;
(Continued)

(56) References Cited

U.S. PATENT DOCUMENTS 141,151 A * 7/1873 Comegys ..... A45B 25/28 135/48
148,573 A * 3/1874 Schamu ..... A45B 25/24 135/34.2

(Continued)

FOREIGN PATENT DOCUMENTS

CN ZL2014 20448924.3 6/2015

OTHER PUBLICATIONS

Machine Translation of CN 202603866.*

*Primary Examiner* — Gideon Weinerth
(74) *Attorney, Agent, or Firm* — Kan Luo

(57) ABSTRACT

A stretchable bottle container comprising a stretchable bottle body, a bottle cap, and portable hanging accessories, useful as an umbrella accessory, or as a packaging and storage container.

The body of the stretchable bottle is a cylinder which has one closed end and one open end, and the wall of the cylinder contains stretchable wavy structures. The open end of the stretchable bottle body is connected with the bottle cap through a detachable tightening seal connection which is airtight and waterproof. The size difference between diameters of the opening of the bottle and that of the body (1) is less than 10%. The open end of the bottle body is soft and deformable under inward pressure of finger squeezes.

Hanging accessories for portability are connectable with the bottle cap through a sectional structure with capability of repeated detachments and re-attachments or through a hanging carabiner which has open and shut configurations. The present utility invention provides a stretchable bottle container with technical advantages of having a wide mouth opening with waterproof and airtight insulation while being (Continued)

soft and deformable under finger squeezes, compactness with compressible volume, easiness in portability and compatibility for different sizes.

6 Claims, 6 Drawing Sheets

(51) Int. Cl.
*A45C 7/00* (2006.01)
*A45C 13/00* (2006.01)
*A45C 13/26* (2006.01)

(52) U.S. Cl.
CPC ..... *A45C 13/008* (2013.01); *A45C 13/26* (2013.01); *Y10S 215/90* (2013.01); *Y10S 224/915* (2013.01)

(58) Field of Classification Search
CPC ..... A45C 13/26; B65D 21/086; B65D 1/32; B65D 11/24; B65D 21/08; B65D 2543/00435; Y10S 215/90; A47G 25/12
USPC ..... 215/341, 900; 135/34.2, 16, 48, 66, 45; 220/666, 6; 224/915; D3/11
See application file for complete search history.

(56) References Cited

U.S. PATENT DOCUMENTS

D28,465 S * 4/1898 Brown ..... D3/11
2,545,022 A * 3/1951 Crewdson ..... A45B 25/24 135/34.2
2,742,913 A * 4/1956 Weisblatt ..... A45B 25/24 135/34.2
3,279,663 A * 10/1966 Torres ..... A45F 5/00 224/251
3,939,887 A * 2/1976 Scarnato ..... B65D 1/0292 206/218
3,939,888 A * 2/1976 Scarnato ..... B65D 1/0292 220/666
4,157,103 A * 6/1979 La Fleur ..... B65D 1/0292 141/338
4,456,023 A * 6/1984 Fujihashi ..... A45B 19/00 135/25.41
4,558,807 A * 12/1985 Jackson ..... A45B 25/24 224/251
D289,945 S * 5/1987 Orenstein ..... D3/11
4,907,614 A * 3/1990 Stamm ..... A45B 9/02 135/15.1
5,111,835 A * 5/1992 Lin ..... A45B 25/28 135/34.2
5,146,940 A * 9/1992 Hamada ..... A45B 25/24 135/34.2
5,195,550 A * 3/1993 Chan ..... A45B 25/24 135/15.1
5,385,162 A * 1/1995 Wu ..... A45B 25/24 135/34.2
5,409,151 A * 4/1995 Freimark ..... A45F 3/16 215/228
5,425,388 A * 6/1995 Chen ..... A45B 25/24 135/34.2
5,562,221 A * 10/1996 Beniacar ..... B65D 1/0292 215/386
5,911,338 A * 6/1999 Miller ..... B65D 21/086 220/666
6,015,077 A * 1/2000 Disher ..... A45B 25/24 135/34.2
6,334,454 B1 * 1/2002 Williams ..... A45B 25/00 135/18
6,412,652 B1 * 7/2002 Woram ..... B65D 21/086 220/521
6,431,406 B1 * 8/2002 Pruett ..... B65D 1/0292 215/900
6,443,338 B1 * 9/2002 Giacona, III ..... A45C 13/30 224/148.6
6,467,654 B1 * 10/2002 Ayres ..... B65D 23/003 222/180
D466,685 S * 12/2002 Gref ..... D3/11
6,626,333 B2 * 9/2003 Levesque ..... A45F 3/04 215/399
6,701,947 B1 * 3/2004 Ramos ..... A45B 25/24 135/34.2
6,805,144 B2 * 10/2004 Usui ..... A45B 25/24 135/34.2
7,108,151 B2 * 9/2006 Higuchi ..... B65D 1/0292 215/381
7,458,480 B2 * 12/2008 Nguyen ..... B65D 21/08 220/359.1
7,866,500 B1 * 1/2011 Peggs ..... B65D 21/0228 220/4.26
8,671,977 B2 * 3/2014 Gonzales Sanz ..... B60S 1/50 137/565.17
8,783,487 B2 * 7/2014 Hojo ..... B65D 1/40 206/277
D728,183 S * 4/2015 Harris ..... D34/1
9,055,794 B1 * 6/2015 Gorouvein ..... A45B 25/00
9,067,723 B2 * 6/2015 Chang ..... B65D 81/2038
2001/0025647 A1 * 10/2001 Chen ..... A45B 25/24 135/15.1
2003/0066838 A1 * 4/2003 Wang ..... B65D 1/32 220/660
2003/0183629 A1 * 10/2003 Wang ..... A42B 1/006 220/9.2
2006/0016819 A1 * 1/2006 Paslawski ..... B65D 1/0292 220/666
2006/0053826 A1 * 3/2006 Drabkin ..... A47G 23/0216 62/457.3
2009/0266391 A1 * 10/2009 Bloom ..... A45B 25/24 135/34.2
2013/0168401 A1 * 7/2013 Avairis ..... B65D 1/32 220/666
2013/0256310 A1 * 10/2013 Hojo ..... B65D 1/40 220/361
2013/0277364 A1 * 10/2013 Kusuma ..... A45F 3/20 220/8
2015/0034661 A1 * 2/2015 Cooper ..... B65B 7/2842 220/666
2015/0253055 A1 * 9/2015 Tsui ..... B65D 21/086 62/62
2016/0135557 A1 * 5/2016 Gorouvein ..... A45B 25/24 220/4.01
2017/0049197 A1 * 2/2017 Boone ..... A45B 25/24
2017/0050800 A1 * 2/2017 Gain ..... B65D 21/086
2018/0118410 A1 * 5/2018 Wood ..... B65D 21/086
2018/0194517 A1 * 7/2018 Brooks ..... B65D 21/068

* cited by examiner

STRETCHABLE BOTTLE CONTAINER

FIELD OF THE INVENTION

This submission is a translation of PCT application PCT/CN2015/000403 for entry into the national phase of United States, and claims priority to patent number ZL2014 20448924.3, which is hereby incorporated by reference in its entirety.

This invention relates to an accessory of umbrellas or a packaging and storage product for miscellaneous items. More particularly, the invention relates to a stretchable bottle container.

BACKGROUND OF THE INVENTION

When people of working-class commute via a crowded public transit during rainy days, every one of them holds the bar handle with one hand while the other hand is occupied with a folding umbrella dripping water down to the floor. The water dripping umbrella becomes a difficult to handle item when there are a lot of people crowded in a space because it can easily wet the clothing and shoes of the owner and that of the others. Moreover, for a majority of people who have formed a habit of looking at their cellphones while taking a ride it is going to be awkwardly impossible to do it during those raining days.

There are some technical problems with the conventional solutions which are listed as follows: The conventional umbrella containers are not waterproof (as shown in FIG. 1) and are only capable of being placed in a vertical position, not in a free-style position in a handbag. They are difficult to carry and transport in batches due to their bulkiness. They are not convenient to take out an umbrella, especially when tilted the residual water is going to leak out. And they are relatively more restraining to users in choices of outfits because they are not easy to carry and they present lower utilization rate due to a fixed volume which is not compatible with variable sizes of umbrellas presenting space utilization problems such as a frequent scenario of a big bottle container being used for a much smaller umbrella.

DETAILED DESCRIPTION OF THE INVENTION

The objectives of the present utility invention are achieved by providing a stretchable bottle container as a solution for problems with conventional technologies such as, inconvenience with residue water out pouring from a container when tilted to take out an umbrella, bulkiness, non-water proof, being low in portability, compatibility and utilization rate.

The invention provides a stretchable bottle container which comprises a stretchable bottle body (1) and a bottle cap (2), and the stretchable bottle body (1) is a cylinder which has one closed end and one open end, and the wall of the cylinder contains stretchable wavy structures. The open end of the stretchable bottle body (1) is connected with the bottle cap (2) through a detachable tightening seal connection which is airtight and waterproof. The size difference between the diameter of the open end of the bottle and that of the bottle body (1) is less than 10%. The open end of the body is configured to change from a circular shape to a substantially oblong shape when subjected to a user's applied hand force between 1 and 40 Newtons.

At the bottom of the stretchable bottle container, there is an optional configuration of zero or one molded hanging hole or an assembly of accessories with hanging holes (6).

Alternatively, the bottle cap (2) is equipped with a collar ring (7) which can be assembled onto the open end of the stretchable bottle body.

Alternatively, the bottle cap (2) is configured with at least one molded hanging hole or an assembly of accessories with hanging holes (5).

Alternatively, the stretchable bottle container comprises zero or at least one hanging accessory (3) for portability.

Alternatively, the portable hanging accessories (3) are exemplified as hanging rings, hanging strings, hanging straps, hanging carabiners or a combination of the aforementioned.

The present invention in one preferred embodiment provides a stretchable bottle container with characteristic stretchiness and compressibility. When taking an umbrella out of the stretchable bottle container, a person only needs to firstly open the bottle cap keeping the open end of the bottle facing upwards, then with one hand holding the top opening of the bottle and the other hand slightly holding the bottom of the bottle, compressing upwardly the body of the bottle by the bottom positioned hand to push the umbrella coming out from the opening of the bottle. At this moment, using one hand slightly squeezing the open end of the bottle with applied force between 1 and 40 Newtons to deform the open end of the bottle from a circular shape to a substantially oblong shape, securing the fixed position of the umbrella when exposed out of the opening of the bottle, the person can easily with another hand take the umbrella out from the bottle container without any residue water out-spilling. The bottle container presents its normal length when being utilized as a container. After the umbrella is taken out to be used, the bottle container is compressible in length and maintains its compressed status with its cap being closed on, which makes it very convenient to be carried along or put in a bag due to its compactness in size. Hence, the stretchable bottle container has advantages of offering easiness to take out an umbrella, a contamination-free floor due to no residue water spilling, compactness in stock volume, and high portability and compatibility.

DETAILED DESCRIPTION OF PREFERRED EMBODIMENTS

The objectives, aspects and advantages of the present invention are more apparent from the following detailed description, particularly when considered in conjunction with the accompanying drawings. However, it should be comprehended that the following detailed description of preferred embodiments are used solely for the purpose of further explanation of rather than providing any limitation to the present invention.

Figure 1:
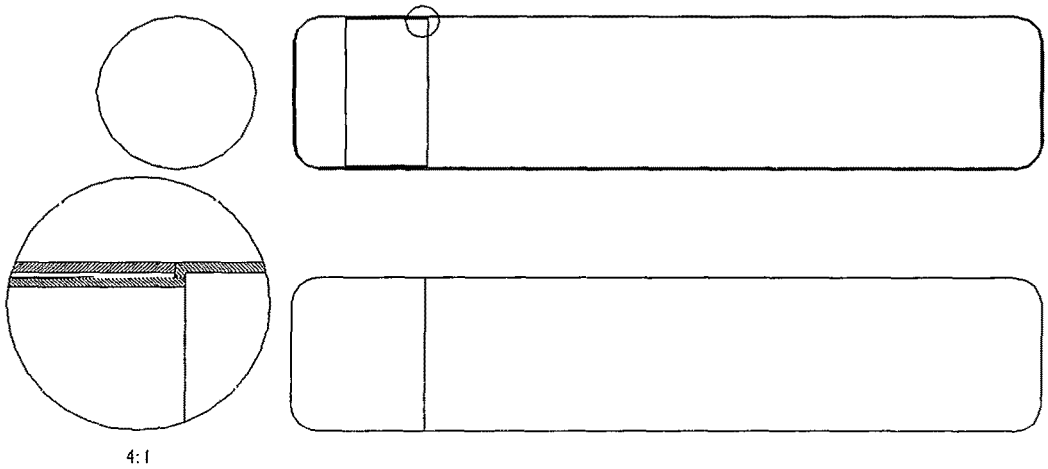
FIG. 1 shows a schematic structure diagram of a conventional umbrella container.
Figure 2:
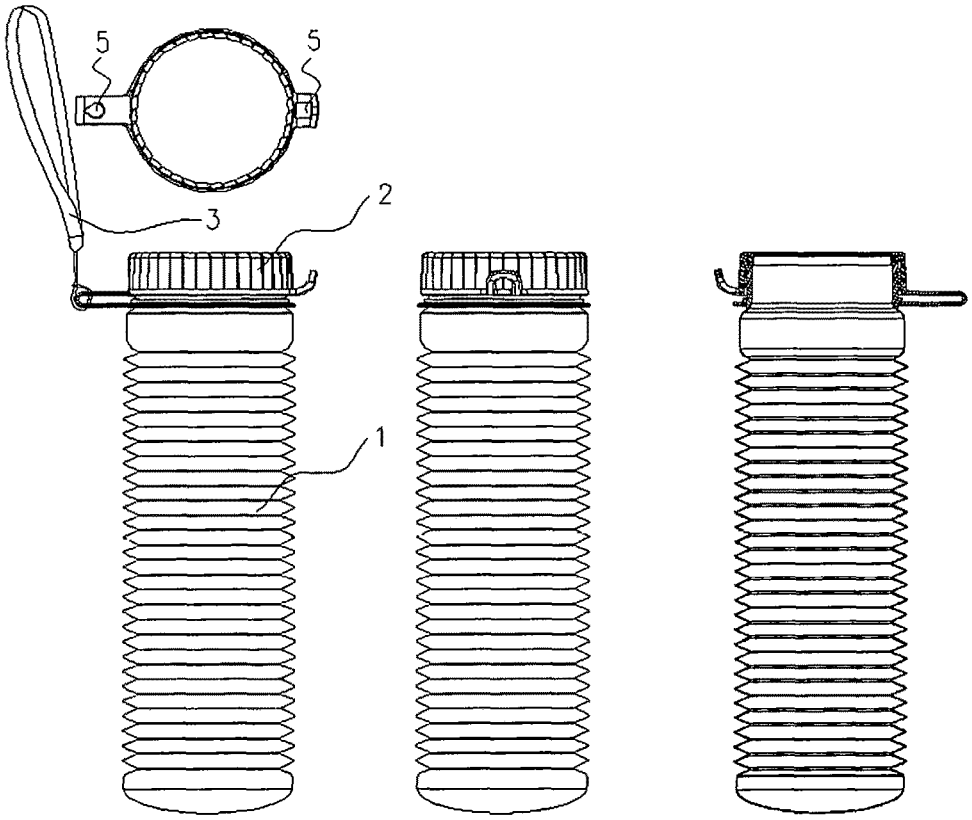
FIG. 2 shows a schematic structure diagram of a stretchable bottle container of this invention.
Figure 3:
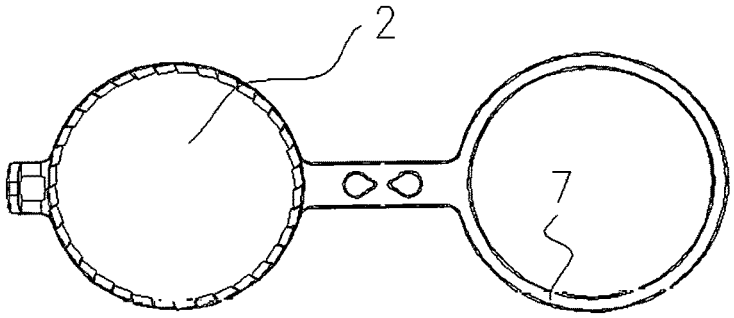
FIG. 3 shows a schematic diagram of the bottle cap and collar ring of this invention.

As an embodiment shown in FIG. 2, the stretchable bottle container comprises: a stretchable body (1) and a bottle cap (2), and the stretchable bottle body (1) is a cylinder which has one closed end and one open end, and the wall of the cylinder contains stretchable wavy structures. The open end of the stretchable bottle body (1) is connected with the bottle cap (2) through a detachable tightening seal connection which is airtight and waterproof. The size difference between the diameter of the opening of the bottle and that of the bottle body (1) is less than 10%. The open end of the bottle body is soft and deformable under inward pressure of finger squeezes.

Figure 6:
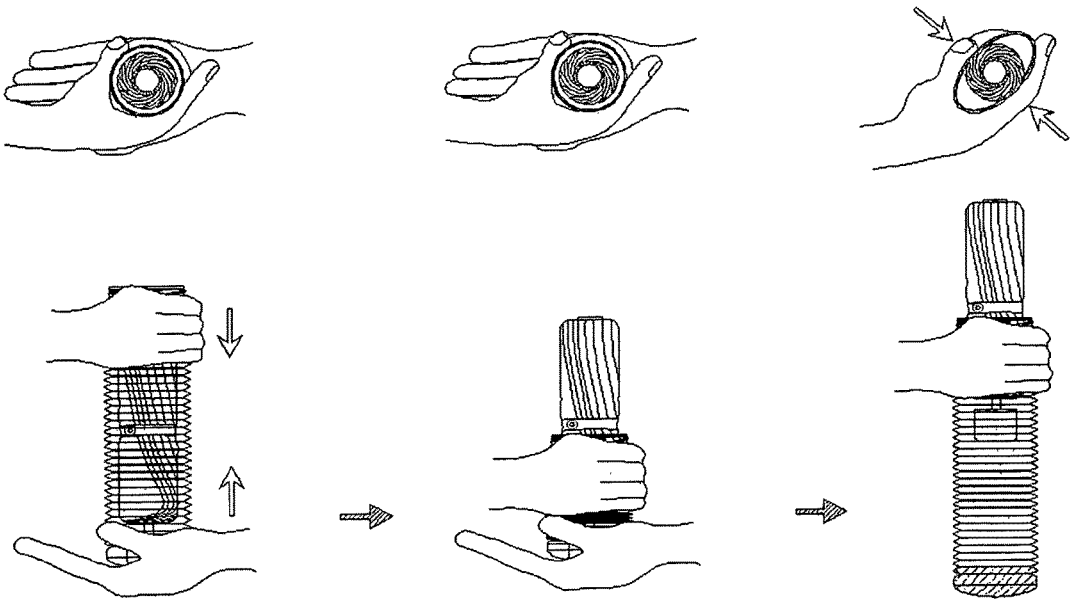
FIG. 6 shows a schematic diagram of taking an umbrella out of this invention without water spilling. Top view illustrates the details of the soft and deformable open end's shape changing from a circle to an oblong under a user's finger squeezes. The bottle cap is omitted to give a better view in this Figure.

As shown in FIG. 6, the present invention provides a stretchable bottle container with characteristic advantages of stretchiness and compressibility. When taking an umbrella out from the stretchable bottle container, a person only needs to firstly open the bottle cap while maintaining the open end of the bottle facing upwards, then with one hand holding the open end of the bottle and with the other hand slightly holding the bottom of the bottle and compressing upwardly the body of the bottle and pushing the umbrella coming out of the opening of the bottle. At this moment, using one hand slightly squeezing the open end of the bottle with applied hand force between 1 and 40 Newtons to deform the open end of the bottle from a circular shape to a substantially oblong shape, and fixing the positioning of the umbrella when exposed out of the opening of the bottle, with another hand, the person can easily take the umbrella out from the bottle container without any residue water out spilling. The bottle cap (2) is omitted in FIG. 6 for a better illustration of the top view of the open end changing from a circular shape to a substantially oblong shape under finger squeezes.

Figure 4:
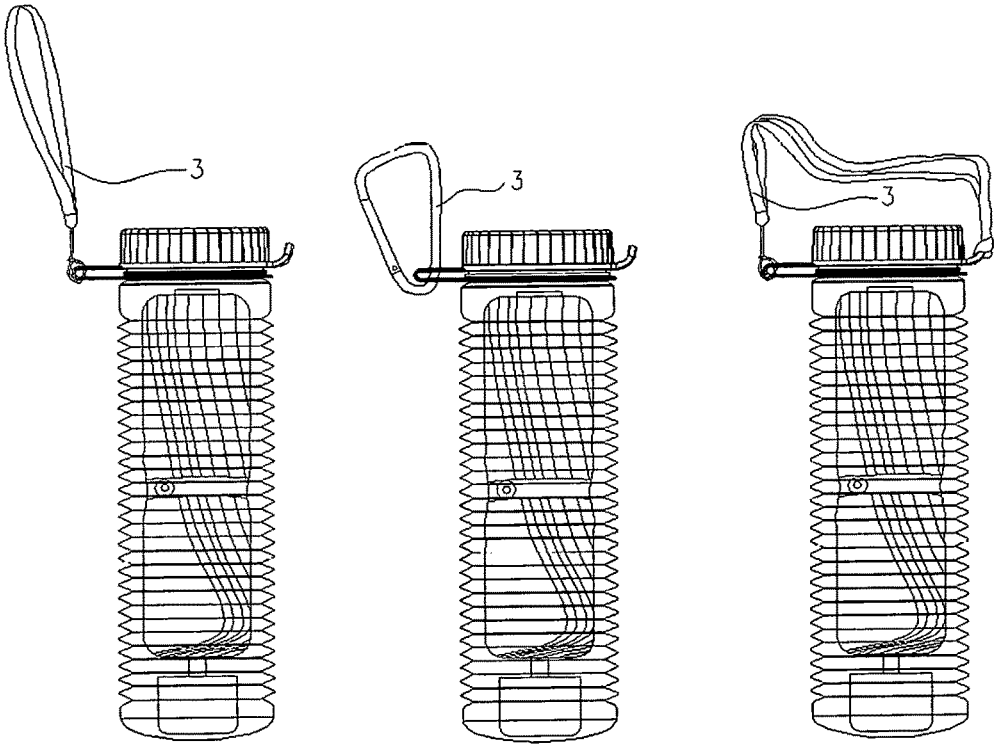
FIG. 4 shows a schematic diagram of a stretchable bottle container of this invention with a variety of hanging accessories while containing an umbrella.
Figure 5:
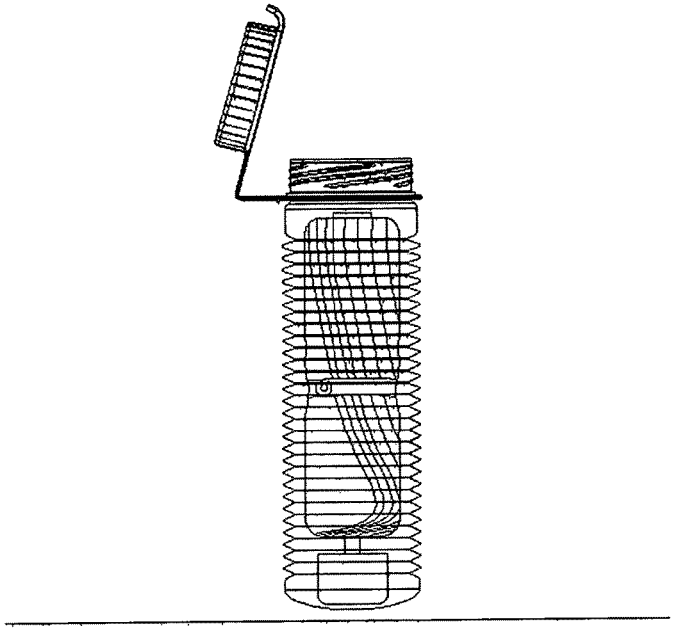
FIG. 5 shows a schematic outline of this invention with the bottle cap being opened.

FIG. 4 depicts the status of the stretchable bottle container after compression. After the item contained inside the stretchable bottle container is taken out, a majority of air originally existing within the bottle (1) is squeezed out. Because of the waterproof and airtight configuration of a connection between the open end of the bottle (1) and the bottle cap (2) in addition to a closed-on cap, the pressure within the bottle is lower than that of the atmosphere resulting from a tendency for the bottle body to restore to its original length, hence the stretchable bottle body is not going to fully extend. Similarly, when putting an item into the bottle, we can cap the bottle closed after compressing the extra space to maintain a relatively smaller volume of a package for an optimized space utilization. As shown in FIGS. 7, 8, 9, 10 and 11, the stretchable bottle container containing an umbrella is capable of being placed at a random angle without any issue of water spilling due to its detachable waterproof tightening connection between the opening of the stretchable body (1) and the bottle cap (2). It is more versatile and flexible as a carry-on item because of its waterproof capability comparing with that of conventional counterparts. It is for the easiness of stuffing in and taking out an item such as an umbrella that the body of the bottle is a cylinder designed with one closed end and one open end as well as the size difference of diameters between the opening of the bottle and the bottle body is maintained to be less than 10%.

Alternatively, the aforementioned bottle cap (2) is equipped with a collar ring (7) which can be assembled onto the open end of the stretchable bottle body (1). The addition of the collar ring (7) can prevent the loss of the bottle cap (2) and avoid any inconvenience of holding the cap with one hand when the bottle is opened and the cap separated from the stretchable bottle body (1).

It is worth specifying that the aforementioned bottle cap (2) can be a single component cap or an assembly of multiple (2 or more than 2) cap components while the stretchable bottle body can be a single component bottle body or an assembly of multiple (2 or more than 2) components of stretchable bottle parts. The specific embodiments of the invention are not limited to the detailed composition and combination of bottle caps and stretchable bottle bodies.

Figure 8:
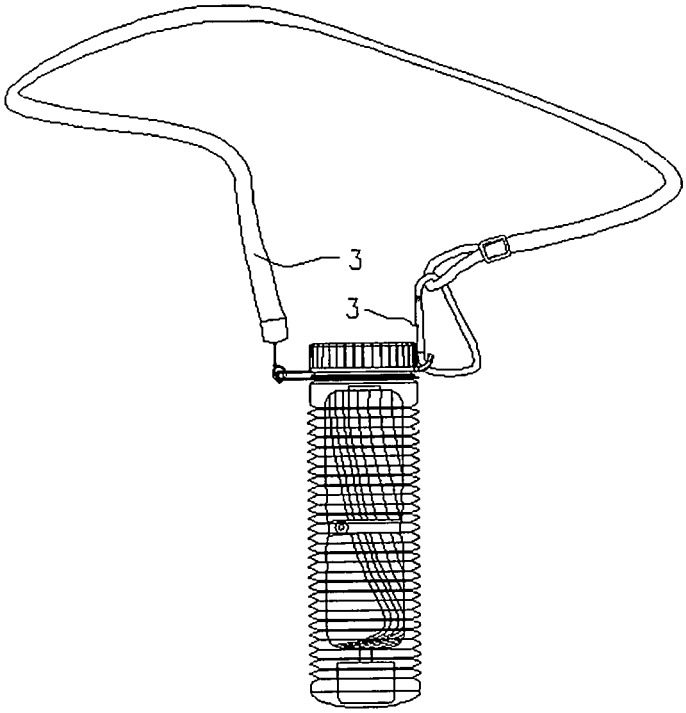
FIG. 8 shows a method of utilizing a long strap with a stretchable bottle container of this invention.
Figure 9:
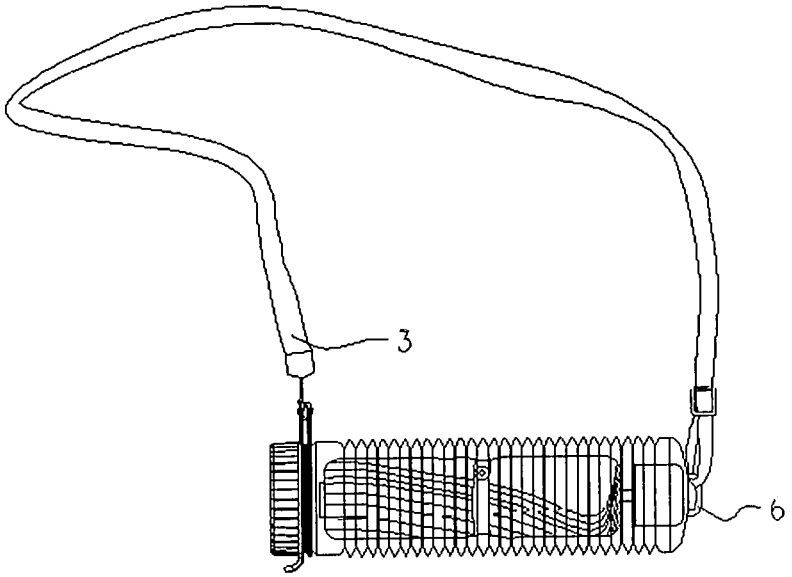
FIG. 9 shows another method of utilizing a long strap with a stretchable bottle container of this invention.
Figure 12:
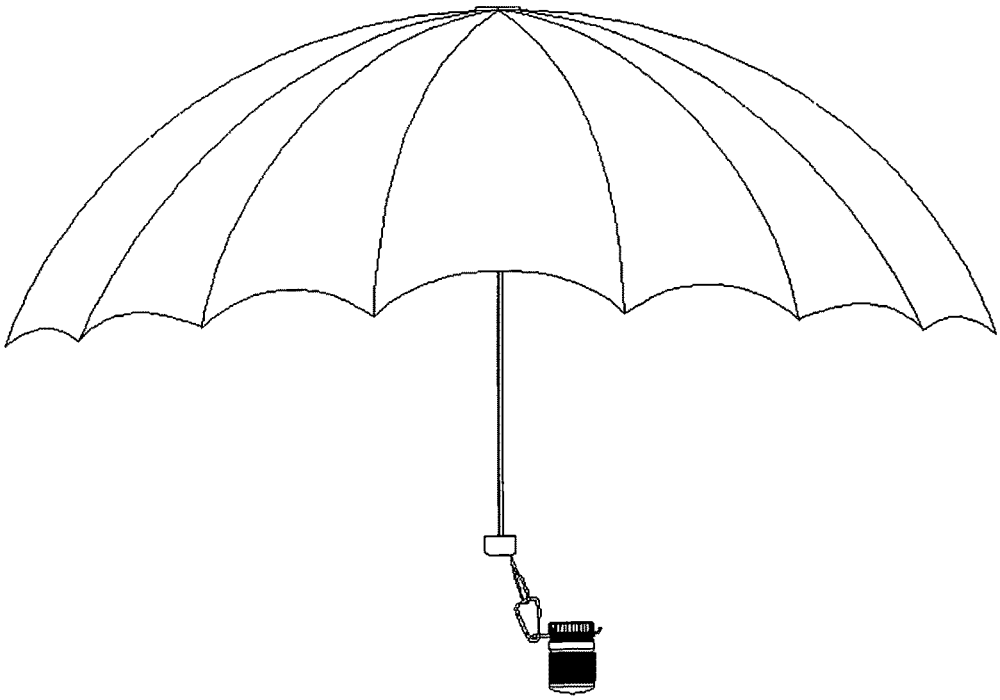
FIG. 12 depicts a stretchable bottle container of this invention hanging on the handle of an umbrella after being compressed.

The aforementioned stretchable bottle container further optionally comprises at least one hanging accessory (3) which can be a soft hanging accessory (3) as shown in FIGS. 2, 8, and 9, exemplified as a repeatedly attachable/detachable connecting structure such as a hanging string or a long strap; or a hard hanging accessory (3) such as a mountain climbing carabiner as shown in FIG. 12. Adoption of these configurations enables umbrellas being carried along with ease and convenience. The aforementioned portable hanging accessories (3) are exemplified as hanging rings, hanging strings, hanging straps, hanging carabiners etc.

Figure 7:
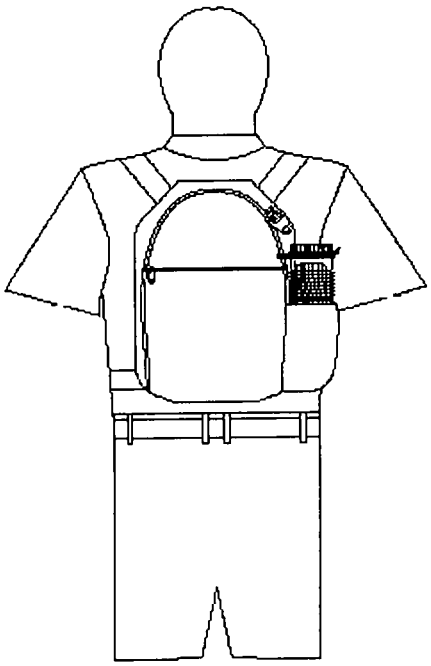
FIG. 7 depicts the stretchable bottle container of this invention containing an umbrella in the side pocket of a backpack.
Figure 10:
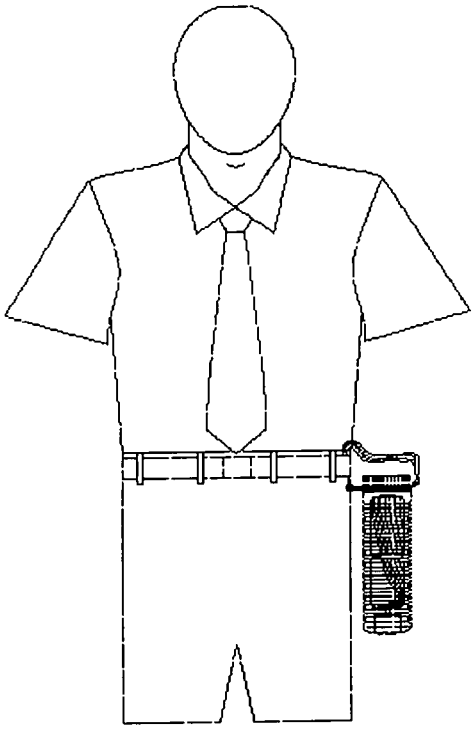
FIG. 10 depicts a stretchable bottle container of this invention hanging on a belt.
Figure 11:
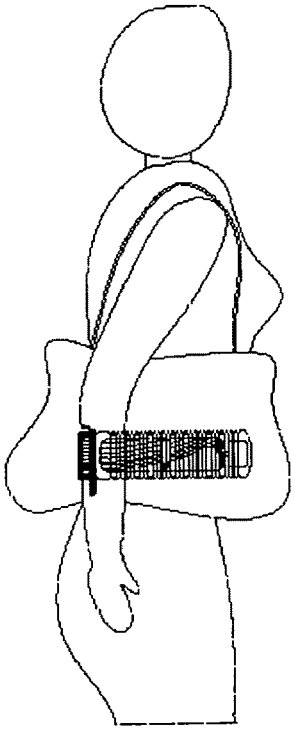
FIG. 11 shows the silhouette of a stretchable bottle container of this invention containing an umbrella in a handbag.

The aforementioned bottle cap (2) is further optionally configured with a molded hanging hole or an assembly of accessories with hanging holes (5) as shown in FIG. 2. The bottom part of the bottle body (1) is further optionally configured with zero or one molded hanging hole or an assembly of accessories with hanging holes (6) as shown in FIG. 9. The configuration of a molded hanging hole or an assembly of accessories with hanging holes (5) and (6) is designed to achieve convenience and flexibility in choosing or changing hanging accessories according to actual occasions. Some examples are shown in FIGS. of 2, 4, 8, and 9. FIG. 12 depicts that the stretchable bottle container is hanging on the handle of an umbrella after the bottle being compressed to its minimum size when the umbrella is taken out in service. The utility invention can be directly hanged on a backpack clip, placed in a horizontal pocket of a backpack, attached to a small hanging point like a keychain or inserted into a backpack side pocket as shown in FIG. 7. The stretchable bottle container can be placed directly in a handbag after a wet umbrella being folded and enclosed in the bottle with a cap screwed on as shown in FIG. 11. The stretchable bottle container can also be hanged on a belt with a hanging string which has a repeatedly attachable and detachable structure configuration as shown in FIG. 10. It can be utilized in a cross-body style with a long strap configuration as shown in FIGS. 8 and 9. Besides being used as a container for a wet umbrella, the present invention provides a stretchable bottle which can also be conveniently utilized as a portable container for liquids needed for indoor and outdoor activities or as a moisture barrier for storage of moisture-sensitive items or small electronics such as MP3 or flashlights etc. The present invention essentially provides a stretchable carry on bottle container which simultaneously presents all of the characteristics of being foldable, waterproofing, portable, easy to hitch and clip on, and adaptable to a variety of sizes. With the stretchable bottle container to contain wet umbrellas in those rainy days, the problems of wet and slippery floors on public transits can be effectively solved and the embarrassment of getting wet or the disputes between passengers with wet clothes resulting from the wet umbrellas can be greatly reduced. Commuters can handle cellular phones, pads conveniently with at least one hand freed from the utilization of the invention containing their wet umbrellas. Meanwhile, it is also beneficial for car drivers through utilization of this invention to prevent the interior of automobiles from getting wet including upholsteries and floor mats etc.

Although certain preferred embodiments have been specifically described as above mentioned, it must be recognized that they are not limitations of this utility invention and various changes, alternatives, or modifications may be made or chosen without departing from the spirit and scope of the invention and hence should be covered by the present invention.

The invention claimed is:

1. A stretchable bottle container, comprising a stretchable bottle body and a bottle cap;

said stretchable bottle body being a cylinder with stretchable wavy wall structure and having one closed end and one open end;

said open end connected with said bottle cap through a detachable airtight and waterproof tightening seal connection; and said open end configured to change from a circular shape to a substantially oblong shape when subjected to a user's hand applied force between 1 and 40 Newtons.

2. The stretchable bottle container of claim 1, wherein the size difference between the diameters of said open end of said stretchable bottle body and that of said stretchable bottle body is less than 10%.

3. The stretchable bottle container of claim 1, wherein said bottle cap is equipped with a collar ring which can be assembled onto said stretchable bottle body.

4. The stretchable bottle container of claim 1, further comprising at least one hanging accessory for portability purposes, wherein said hanging accessory is connectable with said bottle cap or said stretchable bottle body through a sectional structure which is capable of undertaking repeated detachments and reattachments or through a hanging carabiner which has open and shut configurations.

5. The stretchable bottle container of claim 1, wherein said bottle cap is configured with at least one molded hanging hole or an assembly of hanging accessories with hanging holes; and the closed end of said stretchable bottle body is configured with zero or one molded hanging hole or an assembly of hanging accessories with hanging holes.

6. The stretchable bottle container of claim 4 or 5, wherein the hanging accessory or accessories can be any one of the following items: a hanging ring, a hanging strap, a hanging string with a repeatable attachment and detachment structure or a hanging carabiner with open and shut configurations.

* * * * *